US009429918B2

(12) United States Patent
Parsa et al.

(10) Patent No.: US 9,429,918 B2
(45) Date of Patent: Aug. 30, 2016

(54) ATOMIC CLOCKS AND MAGNETOMETERS WITH VAPOR CELLS HAVING CONDENSATION SITES IN FLUID COMMUNICATION WITH A CAVITY TO HOLD A VAPOR CONDENSATION AWAY FROM AN OPTICAL PATH

(71) Applicant: Texas Instruments Incorporated, Dallas, TX (US)

(72) Inventors: Roozbeh Parsa, San Jose, CA (US); Peter J. Hopper, San Jose, CA (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 139 days.

(21) Appl. No.: 14/309,966

(22) Filed: Jun. 20, 2014

(65) Prior Publication Data

US 2015/0372686 A1 Dec. 24, 2015

(51) Int. Cl.
*G04F 5/14* (2006.01)

(52) U.S. Cl.
CPC ..... *G04F 5/14* (2013.01); *Y10T 29/49828* (2015.01)

(58) Field of Classification Search
CPC ..... H03L 7/26; G04F 5/14; G04F 5/063; G21B 1/03; B01D 5/0036; B01D 5/009; B01D 53/002
USPC ..... 250/214.1, 239, 216, 214 VT; 331/3, 331/94.1, 176
See application file for complete search history.

(56) References Cited

U.S. PATENT DOCUMENTS 5,327,105 A * 7/1994 Liberman ..... H03L 7/26 331/3
6,570,459 B1 5/2003 Nathanson et al.
2012/0256696 A1 10/2012 Lecomte et al.

OTHER PUBLICATIONS

"Principles of Atomic Clocks,"EFTF-IFCS 2011 Tutorial, May 1, 2011, San Francisco, CA, Symmetricom—Technology Realization Center, pp. 1-141 (Robert Lutwak).
"Microfabricated Atomic Clocks And Magnetometers," Time and Frequency Division, National Institute of Standards and Technology, Boulder, CO 80305, 1 page (Knappe, et al.).
"Microfabricated Atomic Clocks At NIST," 36th Annual Precise and Time Interval (PTTI) Meeting, Time and Frequency Division, NIST, Boulder, CO, pp. 1-11 (knappe, et al.).
"Microfabricated Atomic Clocks And Magnetometers," Institute of Physics Publishing, Journal of Optics A: Pure and Applied Optics, Time and Frequency Division, National Institute of Standards and Technology, Boulder, CO, pp 1-5 (Knappe, et al.).

* cited by examiner

*Primary Examiner* — Que T Le
(74) *Attorney, Agent, or Firm* — Daniel Chan; Frank D. Cimino

(57) ABSTRACT

A vapor cell for installation in an atomic clock or a magnetometer. The vapor cell includes a top plate, a center plate, and a bottom plate defining a cavity for passing light along an optical path. The vapor cell includes one or more condensation sites to trap condensed vapor in order to avoid blockage of the optical path.

20 Claims, 2 Drawing Sheets

ATOMIC CLOCKS AND MAGNETOMETERS WITH VAPOR CELLS HAVING CONDENSATION SITES IN FLUID COMMUNICATION WITH A CAVITY TO HOLD A VAPOR CONDENSATION AWAY FROM AN OPTICAL PATH

FIELD OF THE INVENTION

The present invention relates to atomic clocks and magnetometers and, more particularly, to a micro-fabricated atomic clock or magnetometer and a method of forming self-condensing silicon vapor cell cavity structure for an atomic clock or magnetometer.

BACKGROUND OF THE INVENTION

An atomic clock is an oscillator that provides unmatched frequency stability over long periods of time because their resonance frequency is determined by the energy transition of the atoms, in contrast to crystal oscillators, where the frequency is determined by the length of the crystal and is therefore much more susceptible to temperature variations.

Atomic clocks are utilized in various systems which require extremely accurate and stable frequencies, such as in bistatic radars, GPS (global positioning system) and other navigation and positioning systems, as well as in communications systems, cellular phone systems and scientific experiments, by way of example.

In one type of atomic clock, a cell containing an active medium such as cesium (or rubidium) vapor is irradiated with optical energy whereby light from an optical source pumps the atoms of the vapor from a ground state to a higher state from which they fall to a state which is at a hyperfine wavelength above the ground state. In this manner a controlled amount of the light is propagated through the cell and is detected by means of a photodetector.

An optical pumping means, such as a laser diode is operable to transmit a light beam of a particular wavelength through the active vapor, which is excited to a higher state. Absorption of the light in pumping the atoms of the vapor to the higher states is sensed by a photodetector which provides an output signal proportional to the impinging light beam on the detector.

By examining the output of the photodetector, a control means provides various control signals to ensure that the wavelength of the propagated light is precisely controlled.

In operation, alkali metal deposits have a tendency to condense at the center of the top glass plate of the alkali cell just below the photodetector, thus causing significant signal loss due to reduced light transmission. There is a need for a method of reducing or eliminating the metal deposits on the center of the top glass plate of the alkali cell.

SUMMARY OF THE INVENTION

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present some concepts of the invention in a simplified form as a prelude to a more detailed description that is presented later.

In accordance with an embodiment of the present application, a vapor cell is provided. The vapor cell comprises: a cell structure comprised of a center plate sandwiched between top and bottom plates; the center plate has a top and bottom surface and includes a central interior aperture extending completely through the plate, having sharp corners in the side of the aperture at the top of the center plate; the top and bottom plates are substantially optically transparent to radiation passing through the vapor cell structure during operation of the device, each having top and bottom surfaces; the top surface of the bottom plate is bonded to the bottom surface of the center plate; heaters and sensors are attached to the undersurface of the bottom plate; the bottom surface of the top plate attached to the top surface of the center plate, after which a photodetector is attached to the top surface of top plate; an interior cavity formed from the interior aperture in the center plate, when sealed with the top and bottom plates, wherein the top and bottom plates are configured to provide transparent apertures composed of curved surface interior walls that define lens portions of top plate and bottom plate to collimate a laser beam projected through the interior cavity; the interior cavity is filled with a cesium or rubidium vapor, as well as any buffer gas; and a laser diode configured to provide laser light to excite the cesium or rubidium vapor in the interior cavity.

In accordance with another embodiment of the present application, a method of forming a vapor cell is provided. The method of forming a vapor cell comprising: forming a center plate that includes a central interior aperture extending completely through the plate, the central interior aperture having sharp corners in the side of the aperture at the top of the center plate using one or more wet or dry etches to form the central interior aperture; providing top and bottom plates, wherein the top and bottom plates are composed of Sodium borosilicate glass and are substantially optically transparent to radiation, wherein the top and bottom plates are configured to provide transparent apertures composed of curved surface interior walls that define lens portions of the top and bottom plates to collimate a laser beam projected through an interior cavity; forming the interior cavity in the center plate, by sealing the interior aperture of the center plate with the top and bottom plates, wherein the sealing of the wafers may be accomplished by well-known techniques which utilize pressure, increased temperature and electric field technology to result in diffusion and drift-driven bonding between elements; attaching heaters and sensors to the undersurface of the bottom plate; attaching a photodetector to the top surface of top plate; filling the interior cavity with an alkali gas of either cesium or rubidium vapor, as well as any buffer gas; and providing a laser diode configured to provide laser light to excite the cesium or rubidium vapor in the interior cavity; wherein, sharp corners in the sides central interior aperture at the top of the center plate provide high energy condensation sites, thus minimizing condensation of the alkali gas on the coolest portion of the cell, the bottom surface of the top plate.

In accordance with a third embodiment of the present application, a method of operating a vapor cell is provided. The method of operating a vapor cell comprising: providing a vapor cell comprised of: a cell structure comprised of a center plate sandwiched between top and bottom plates, wherein the center plate has a top and bottom surface and includes a central interior aperture forming an interior cavity in the vapor cell and the top and bottom plates are substantially transparent; wherein the top and bottom plates are configured to provide transparent apertures composed of curved surface interior walls that define lens portions of the top and bottom plates to collimate a laser light projected through an interior cavity; wherein the interior cavity is filled with an alkali gas of either cesium or rubidium vapor, as well as any buffer gas; a photodetector attached to the top of the vapor cell; and a laser diode configured to provide laser light to excite the cesium or rubidium vapor in the interior cavity; passing a laser light from the laser diode through the interior cavity of the vapor cell to interact with the alkali vapor within the interior cavity, thereby exciting the alkali gas; and measuring the laser light passing through the interior cavity with the photodetector, wherein signals from the photodetector are provided to clock generation circuitry, which uses the signals to generate a clock signal and also provides signals to a controller which controls operation of the laser diode and ensures closed-loop stabilization of the atomic clock.

DESCRIPTION OF THE VIEWS OF THE DRAWINGS

In the drawings, like reference numerals are sometimes used to designate like structural elements. It should also be appreciated that the depictions in the figures are diagrammatic and not to scale.

DETAILED DESCRIPTION OF EXAMPLE EMBODIMENTS

Figure 1:
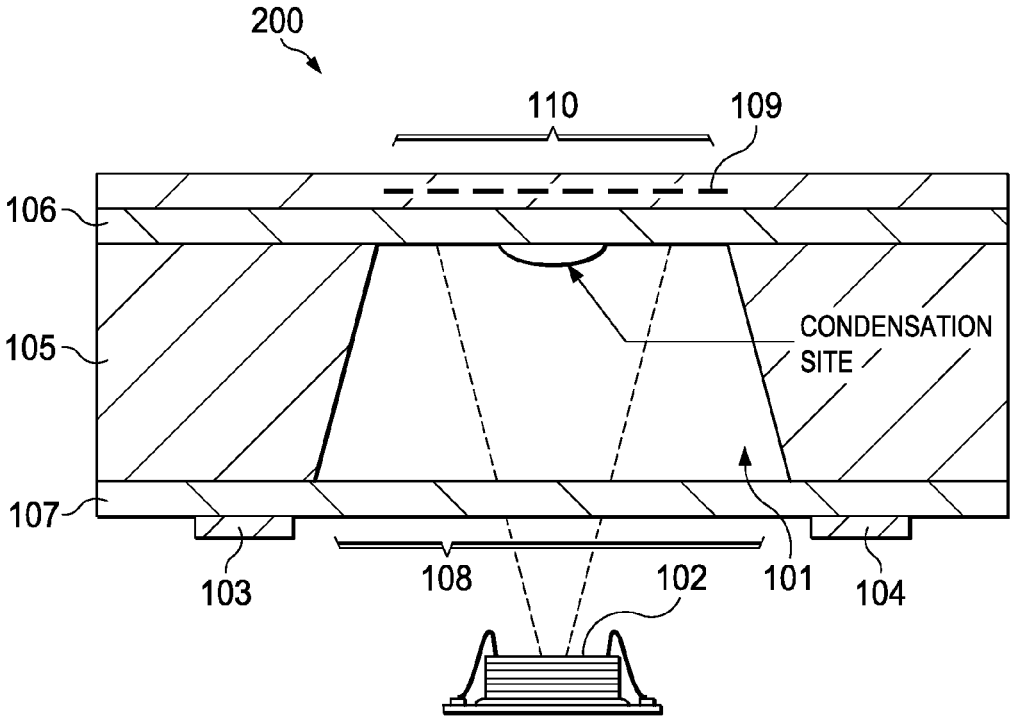
FIG. 1 (PRIOR ART)
FIG. 1 (Prior art) is a cross-section of an atomic clock vapor cell.

The present invention is described with reference to the attached figures. The figures are not drawn to scale and they are provided merely to illustrate the invention. Several aspects of the invention are described below with reference to example applications for illustration. It should be understood that numerous specific details, relationships, and methods are set forth to provide an understanding of the invention. One skilled in the relevant art, however, will readily recognize that the invention can be practiced without one or more of the specific details or with other methods. In other instances, well-known structures or operations are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

An atomic frequency standard, or atomic clock, basically consists of a package having a cell 101 filled with an active vapor such as a vapor of cesium or rubidium. An optical pumping means, such as a laser diode 102 is for an ultra small, completely portable, highly accurate and extremely low power atomic clock. The atomic frequency standard or atomic clock also includes a physics package (not shown).

The optical pumping means, such as a laser diode 102 is operable to transmit a light beam of a particular wavelength through the active vapor included in cell 101, which is excited to a higher state. Absorption of the light in pumping the atoms of the vapor to the higher states is sensed by a photodetector 109 which provides an output signal proportional to the impinging light beam on the detector.

In order to generate the required vapor pressure in cell 101, the active vapor is heated by a heater 103. The precisely controlled cell temperature is accomplished with the provision of heater control (not shown), in conjunction with temperature sensor 104 which monitors the cell temperature at the coldest point in the vapor envelope and provides this temperature indication, via feedback circuitry (not shown), to a microprocessor (not shown).

The cross-sectional view of FIG. 1 illustrates a cell structure 200 comprised of a center plate 105 which is sandwiched between top and bottom plates 106 and 107. Center plate 105 includes a central interior aperture 101 extending completely through the plate. The central plate 105 can be composed of silicon, to which can be applied well-established fabrication techniques and the top 106 and bottom 107 plates can be composed of a transparent material that is substantially optically transparent to radiation passing through the vapor cell structure during operation of the device, such as Sodium borosilicate glass.

As indicated in FIG. 1, bottom plate 107 can be attached to center plate 105, after which, heaters 103 and sensors 104 can be deposited on the undersurface of the bottom plate 107.

As also indicated in FIG. 1, a top plate 106 can be attached to central plate 105, after which a photodetector 109 can be attached to the top surface of top plate 106.

Alkali materials such as cesium or rubidium react violently in air and water and are corrosive to many materials. All of the plates 105, 106 and 107 are exposed to the cesium or rubidium vapor. Accordingly, the plates 106, 107 and 105, must be of a material which is inert to the cesium or rubidium. Sodium borosilicate glasses and single crystal silicon are known to satisfy this condition.

Transparent aperture 110 in end section 106 receives light for the photodetector 109 and transparent aperture 105 in end section 107 transmits laser light from the laser diode 102 into the interior aperture 101, exciting the alkali gas. These apertures can have an optional feature of the cell structure 200 in as much as one, or both, of the apertures 108 and 110 may be composed of curved surface interior walls that can define lens portions of top plate 106 and bottom plate 107 to collimate the laser beam projected through interior aperture 101.

Center plate 105 additionally includes a well, or reservoir 101 into which will be placed the source of the vapor, for example, cesium or rubidium. When sealed with the top and bottom plates 106 and 107, the interior aperture 101 forms an internal cavity for the cesium or rubidium vapor, as well as any buffer gas which normally may be utilized.

In addition, when assembled, the plates form a sandwich which must be sealed. The sealing of the wafers may be accomplished by well-known techniques which utilize pressure, increased temperature and electric field technology to result in diffusion and drift-driven bonding between elements.

In operation, the cesium or rubidium gas will condense in cesium or rubidium metal on the coolest surface of the cell. In most cases, the coolest portion of the cell is on the bottom surface of the top plate 106, where the light from the laser projects through the top plate 106 to be sensed by the photodetector 109.

Condensation in the area directly in line with the photodetector is problematic since the condensed material of the top plate 106 can result in erroneous readings by the photodetector 109 and thus deviations in the time base of the atomic clock.

A solution to the above problem is to attract the alkali metal away from the center of top plate 106. This can be accomplished by providing sharp corner in the side of the cavity 101 at the top of the center plate 105. Sharp corners in the sides of the cavity 101 at the top of the center plate 105 can provide high energy condensation sites.

Figure 2:
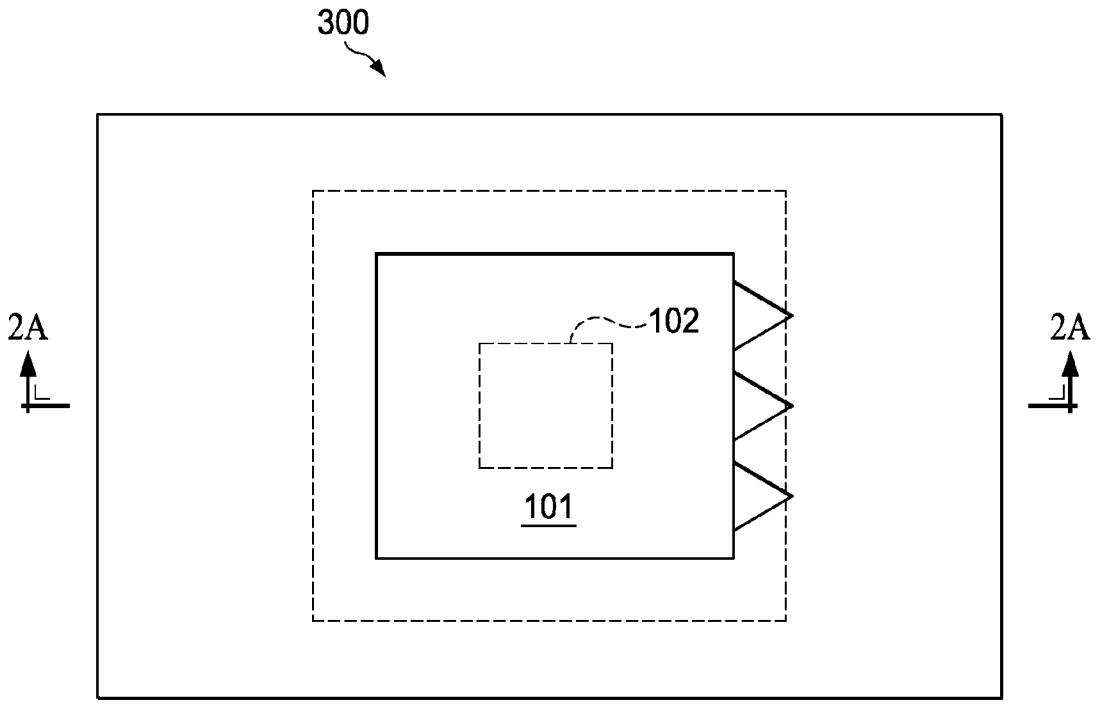
FIG. 2 is a plan view of an atomic clock formed according to embodiments of this invention.
Figure 2A:
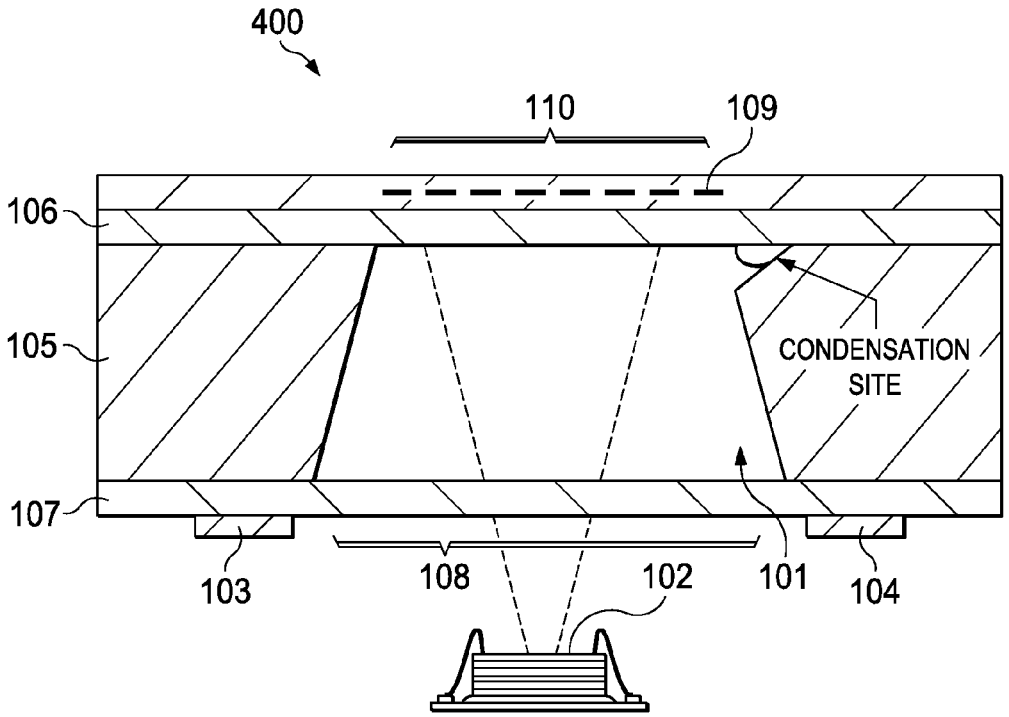
FIG. 2A is a cross sectional view of FIG. 2 at section A-A.

FIGS. 2 and 2A illustrate an embodiment of the present invention. FIG. 2 shows a plan view of the cell structure 300 and 2A shows a cross section of FIG. 2 at section A-A. Sharp corners in the sides of the cavity 101 at the top of the center plate 105 can be formed in the silicon wafer using one or more wet or dry etches.

The vapor cell structure as described above provides a structure that minimizes the alkali metal condensation at the middle of the top plate 106. The radiation from the laser diode passes through the interrogation cavity 101 of the vapor cell 300 and interacts with the alkali metal vapor. The radiation can also interact with the photodetector that measures the radiation passing through the interrogation cavity 101. For example, photodetector can measure radiation from the laser diode. Signals from the photodetector are provided to clock generation circuitry (not shown), which uses the signals to generate a clock signal. When the metal vapor is, for example, rubidium 87 or cesium 133, the signal generated by the clock generation circuitry (not shown) could represent a highly-accurate clock. The signals from the photodetector are also provided to a controller circuit (not shown), which controls operation of the laser diode 102. The controller (not shown) helps to ensure closed-loop stabilization of the atomic clock.

While various embodiments of the present invention have been described above, it should be understood that they have been presented by way of example only and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

What is claimed is:

1. An atomic clock, comprising:
a vapor cell structure including:
a bottom transparent plate;
a top transparent plate opposing the bottom transparent plate; and
a center plate positioned between the top and bottom transparent plates, the center plate defining a central interior aperture to form a cavity upon being attached to the top and bottom transparent plates, the center plate defining a condensation site with the top transparent plate, the condensation site in fluid communication with the cavity and positioned to hold a vapor condensation away from an optical path extending across the top and bottom transparent plates and through the central interior aperture.

2. The atomic clock of claim 1, wherein the center plate includes a crystal silicon material.

3. The atomic clock of claim 1, wherein the top and bottom transparent plates each includes a Sodium borosilicate glass material.

4. The atomic clock of claim 1, further comprising:
a heater attached to the bottom transparent plate and away from the optical path.

5. The atomic clock of claim 1, further comprising:
a temperature sensor attached to the bottom transparent plate and away from the optical path.

6. The atomic clock of claim 1, further comprising:
a photodetector attached to the top transparent plate and within the optical path.

7. The atomic clock of claim 1, further comprising:
a laser diode positioned below the bottom transparent plate, the laser diode configured to emit a light ray along the optical path.

8. The atomic clock of claim 1, wherein the central interior aperture has a top opening and a bottom opening larger than the bottom opening, and the condensation site is positioned adjacent to the top opening.

9. The atomic clock of claim 1, wherein the condensation site defines an acute angle between the center plate and the top transparent plate.

10. The atomic clock of claim 1, further comprising:
a vapor filling the cavity, the vapor including an alkali material selected from a group consisting of cesium and rubidium.

11. A magnetometer, comprising:
a vapor cell structure including:
a bottom transparent plate;
a top transparent plate opposing the bottom transparent plate; and
a center plate positioned between the top and bottom transparent plates, the center plate defining a central interior aperture to form a cavity upon being attached to the top and bottom transparent plates, the center plate defining a condensation site with the top transparent plate, the condensation site in fluid communication with the cavity and positioned to hold a vapor condensation away from an optical path extending across the top and bottom transparent plates and through the central interior aperture.

12. The magnetometer of claim 11, wherein the center plate includes a crystal silicon material.

13. The magnetometer of claim 11, wherein the top and bottom transparent plates each includes a Sodium borosilicate glass material.

14. The magnetometer of claim 11, further comprising:
a heater attached to the bottom transparent plate and away from the optical path.

15. The magnetometer of claim 11, further comprising:
a temperature sensor attached to the bottom transparent plate and away from the optical path.

16. The magnetometer of claim 11, further comprising:
a photodetector attached to the top transparent plate and within the optical path.

17. The magnetometer of claim 11, further comprising:
a laser diode positioned below the bottom transparent plate, the laser diode configured to emit a light ray along the optical path.

18. The magnetometer of claim 11, wherein the central interior aperture has a top opening and a bottom opening larger than the bottom opening, and the condensation site is positioned adjacent to the top opening.

19. The magnetometer of claim 11, wherein the condensation site defines an acute angle between the center plate and the top transparent plate.

20. The magnetometer of claim 11, further comprising:
a vapor filling the cavity, the vapor including an alkali material selected from a group consisting of cesium and rubidium.

* * * * *